United States Patent [19]

Teeter et al.

[11] Patent Number: 5,058,910

[45] Date of Patent: Oct. 22, 1991

[54] AUTOMATICALLY RELEASING SKI BINDING

[75] Inventors: Roger C. Teeter; Larry C. Smith, both of Sumner, Wash.

[73] Assignee: STL International, Incorporated, Tacoma, Wash.

[21] Appl. No.: 169,789

[22] Filed: Mar. 18, 1988

[51] Int. Cl.[5] ..... A63C 9/08

[52] U.S. Cl. ..... 280/14.2; 280/617; 441/70

[58] Field of Search ..... 280/623, 12 R, 12 H, 280/14.2, 607, 617, 618, 636, 809; 441/70

[56] References Cited

U.S. PATENT DOCUMENTS 3,731,328 5/1973 Russell ..... 9/310 AA
4,008,908 2/1977 Pierson ..... 280/607
4,652,007 3/1987 Dennis ..... 280/12 H

FOREIGN PATENT DOCUMENTS 2723864 11/1978 Fed. Rep. of Germany ..... 280/607

*Primary Examiner*—Andres Kashnikow
*Assistant Examiner*—Richard Camby
*Attorney, Agent, or Firm*—Robert W. Beach; Ward Brown

[57] ABSTRACT

A binding for two feet in tandem on one ski that includes a boot for holding the forward foot having a detachable toe holder and a movable retainer secured to the ski between the two feet for holding the boot heel. A foot-engaging member for the rearward foot holds the retainer forward when the rearward foot is in position on the ski, and releases the retainer to free the boot should the rearward foot be removed from the ski.

12 Claims, 9 Drawing Sheets

AUTOMATICALLY RELEASING SKI BINDING

BACKGROUND OF THE INVENTION

When skiing one may use a single ski and place the feet on the ski in tandem arrangement, one foot behind the other. A water ski providing for such placement is shown in Russell U.S. Pat. No. 3,731,328, issued May 8, 1973. It has been found that much better control of the ski is provided if at least the forward foot is firmly held to the ski. If for any reason the skier falls, ordinarily his rearward foot comes loose from the ski and his forward foot remains attached to the ski, which could cause severe injury. When the forward foot is held in a front boot attached to the ski and the rear foot is simply held by a toe strap, the rear foot is usually pulled out of the strap when the skier falls and the forward foot is still held by the boot to the ski. If the skier prefers to have both feet firmly attached to the ski then in a fall either foot could be freed first. If the other foot remains attached to the ski, severe injury could result.

SUMMARY OF THE INVENTION

The principal object of this invention is to insure that, where two feet are in tandem arrangement on the same ski, whenever one foot is separated from the ski the other foot on the same ski is automatically released from the ski.

Specifically it is an object to provide release of the front foot from a ski should the rear foot be separated from the same ski.

It is another object to secure the front foot in place on a ski until the rear foot is inserted in a retainer on the same ski.

To accomplish the foregoing objects, a forward boot is secured at the toe and the heel to a ski. The toe of the boot is inserted into a front hold-down and the boot heel is held by a movably mounted heel retainer kept in a forward position by a holding member located behind the heel retainer. When the rearward foot is separated from the ski the holding member is released so that the front foot boot heel retainer is freed to move rearward and release the front boot from the ski. When the retainer for the rear foot is another boot, that boot has an excessive force release device holding the heel of that boot to the ski. When the rear foot retainer includes an instep strap secured to the ski a lever under the strap is held depressed initially by a latch and subsequently by the ball of the rear foot to hold the front foot boot heel retainer forward, and such lever is released if the foot is removed from beneath the strap to enable the front foot boot heel retainer holding member to release the forward boot heel retainer.

DETAILED DESCRIPTION

Figure 1:
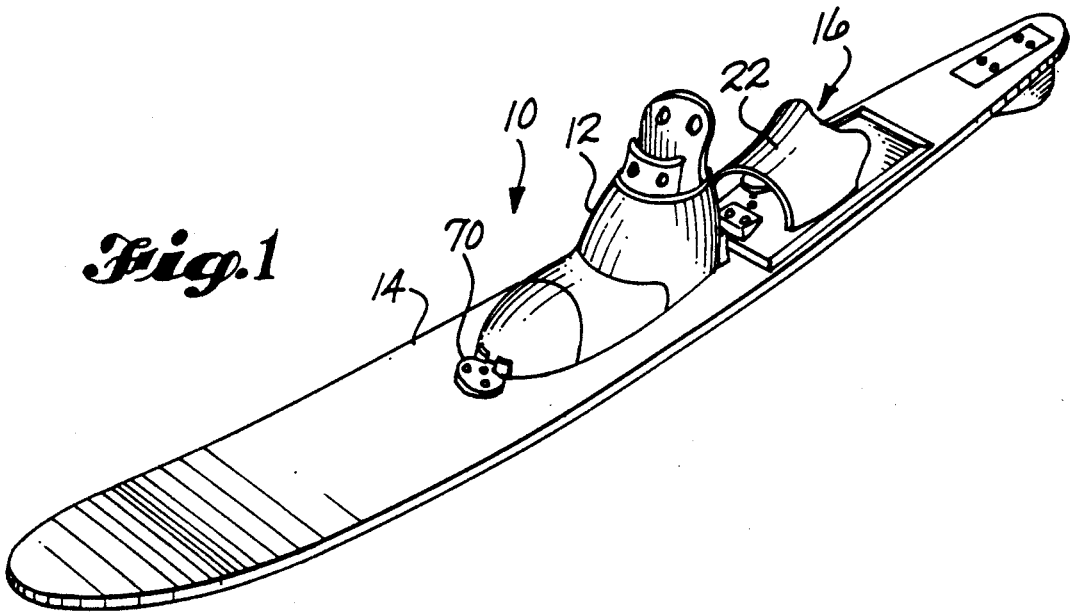
FIG. 1 shows a perspective view of an embodiment of the invention.
Figure 2:
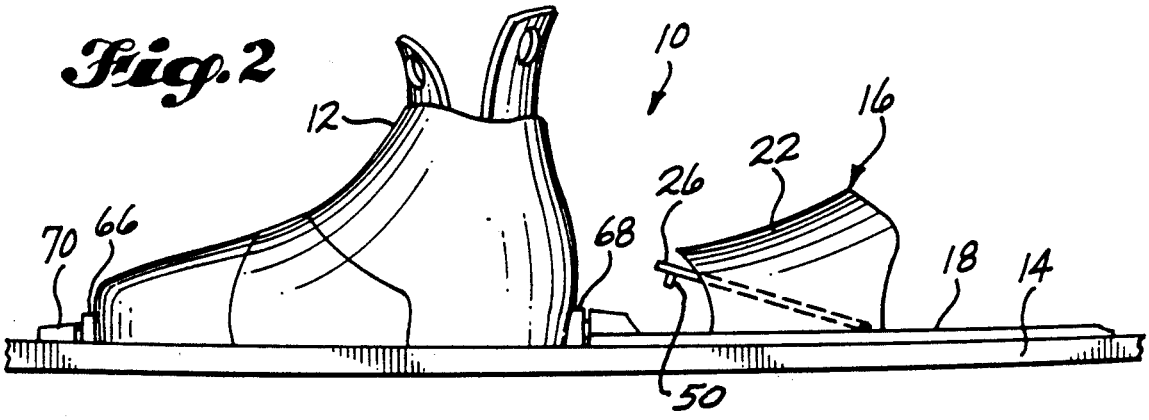
FIG. 2 shows a side elevational view, and FIG. 3 a plan view of the embodiment of FIG. 1.
Figure 3:
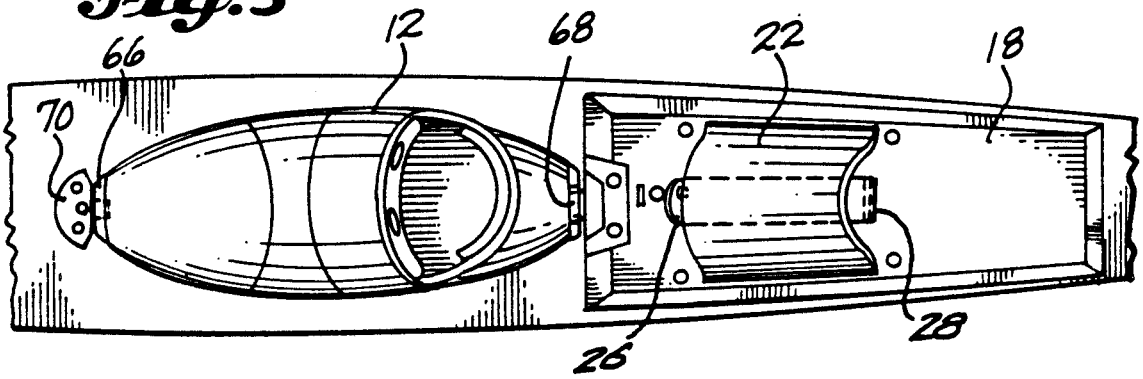
Figure 4:
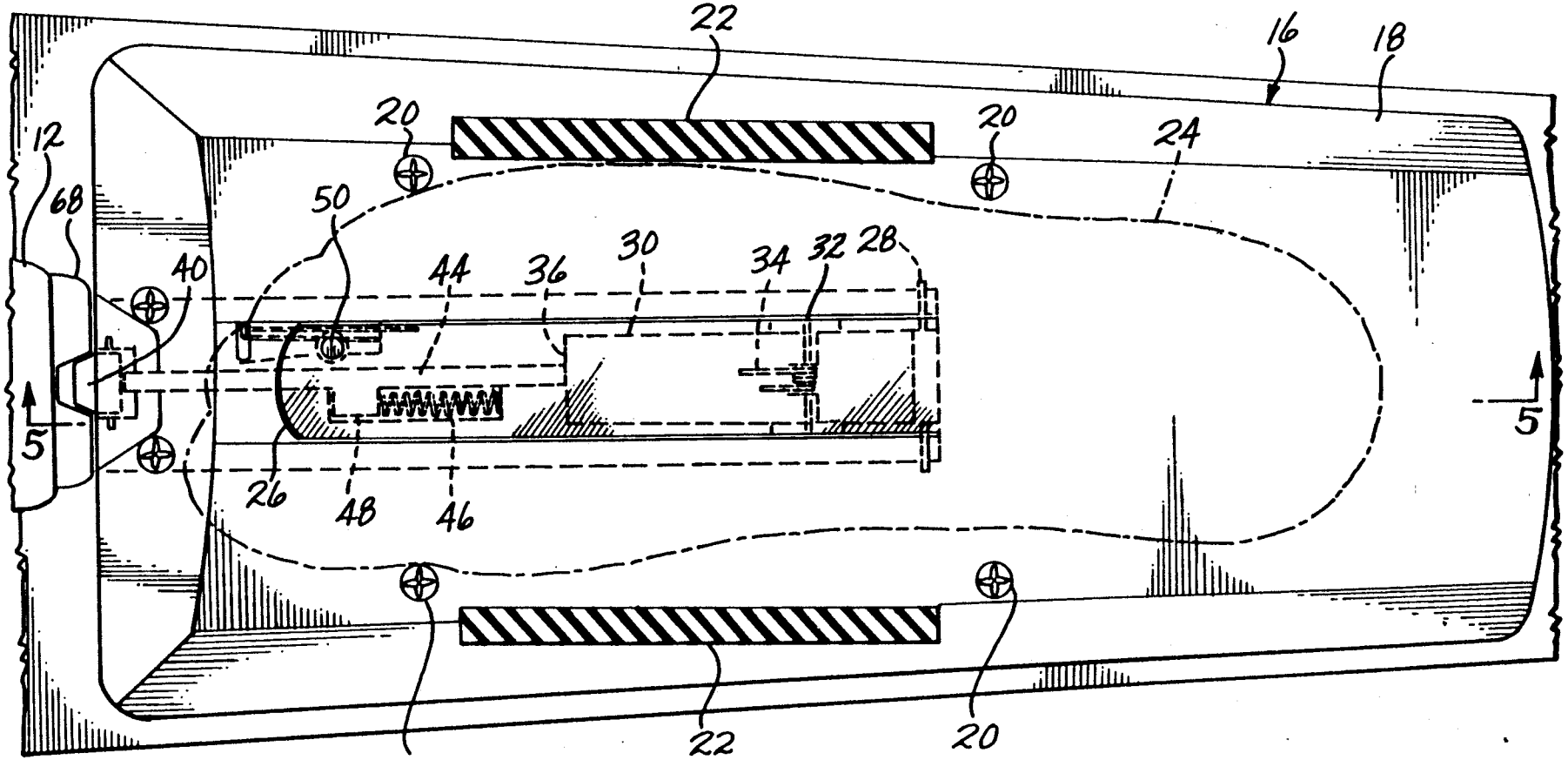
FIG. 4 shows an enlarged view of part of FIG. 3.
Figure 5:
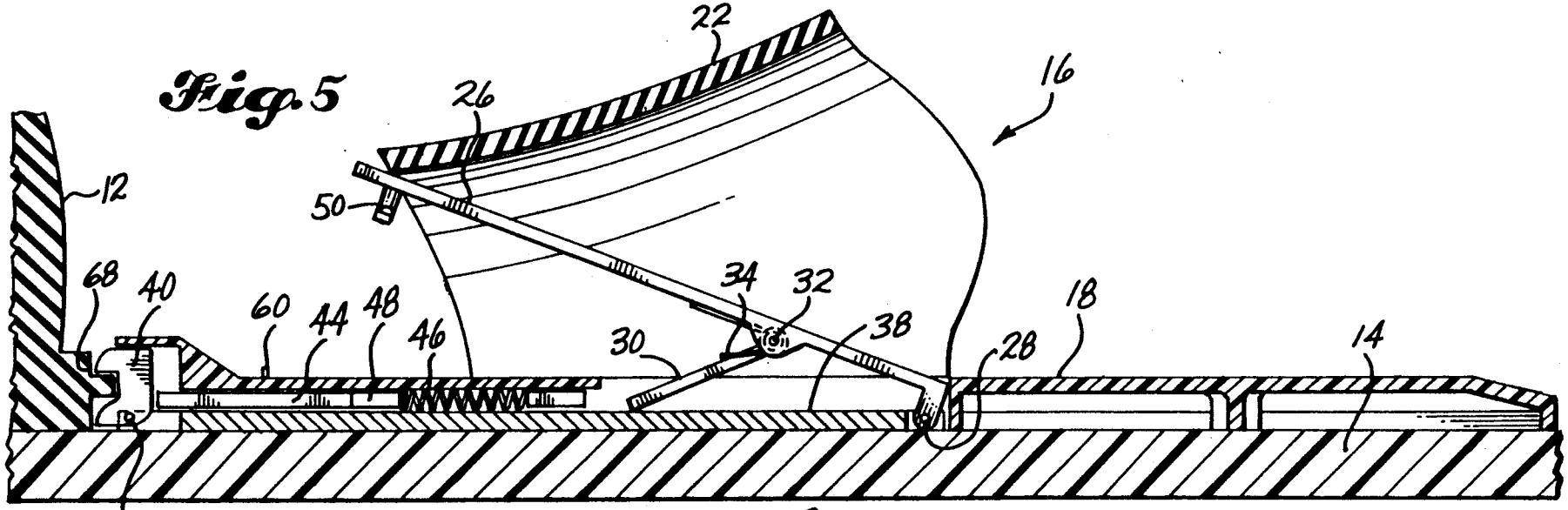
FIGS. 5 and 6 are longitudinal sections taken along line 5—5 of FIG. 4, with FIG. 5 showing the binding in released position and FIG. 6 showing the binding in holding position with a foot in place.
Figure 6:
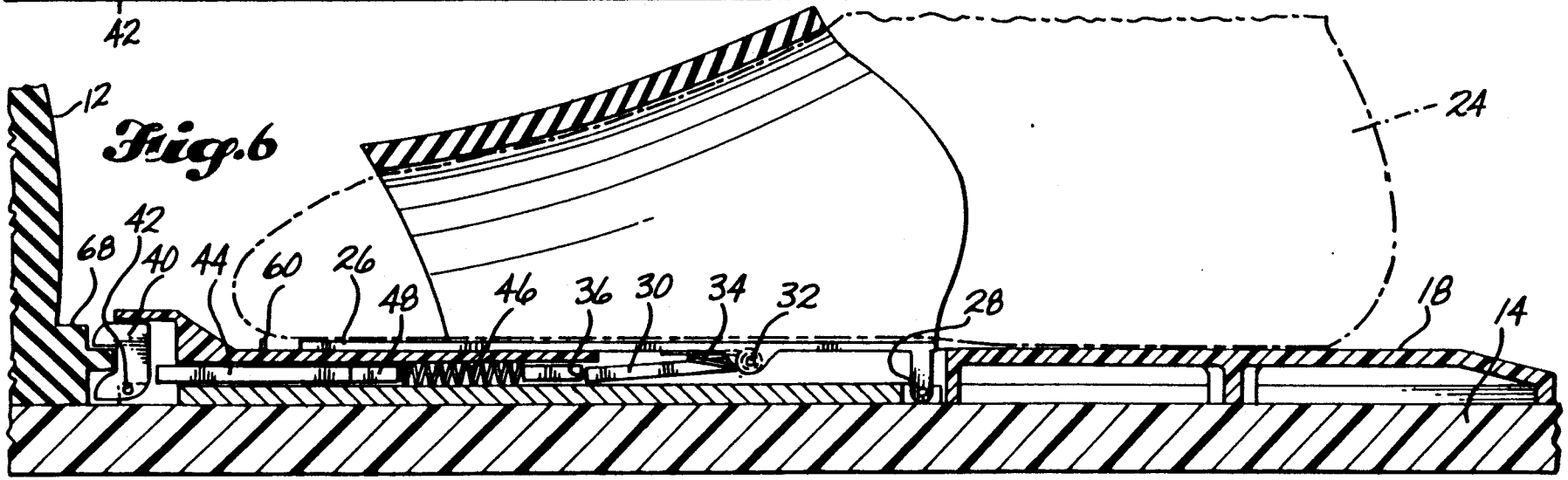

As shown in FIGS. 1 to 15, a ski binding 10 has a foot-engaging member in the form of a foot-holding boot 12 for a forward foot releasably mounted on a ski 14, shown as a water ski, and a rear foot-engaging member 16 on the same ski. The rear foot-engaging member has a base 18 secured to the ski with fasteners 20. A foot-holding instep strap 22 is secured to the base and is located to receive and hold the front portion of a foot 24 shown in broken lines in FIG. 4. A lever 26 is pivotally mounted with pin 28 to the base and extends forward from such pin. A lever arm 30 is pivotally mounted by pin 32 to the underside of lever 26. A torsion spring 34 is mounted on pin 32 in a manner to force lever 26 upward due to the end 36 of the lever arm 30 pressing against the upper surface 38 of base 18 when there is no downward pressure by the foot 24 against the lever 26.

A keeper latch hook 40 is pivotally mounted by pin 42 to the front end of base 18 so as to be held against translation lengthwise of the ski. A slide rod 44 is reciprocally mounted to the base and is located and is of a length to extend between the keeper 40 and the end 36 of lever arm 30 to secure the keeper rigidly in forwardly swing position when the lever 26 is held down by the foot inserted under strap 22. A weak helical compression spring 46 is mounted between base 18 and projection 48 extending laterally from slide rod 44 to urge such rod against latch hook keeper 40. Lifting of the heel of boot 12 would lift such hook and swing the keeper rearward into released position, shifting slide 44 rearward in opposition to the force of spring 46.

The lever 26 has a downwardly extending boss 50, best shown in FIGS. 9 through 12. That boss has a flaring notch 52 in a lateral side of its lower end portion.

Figure 9:
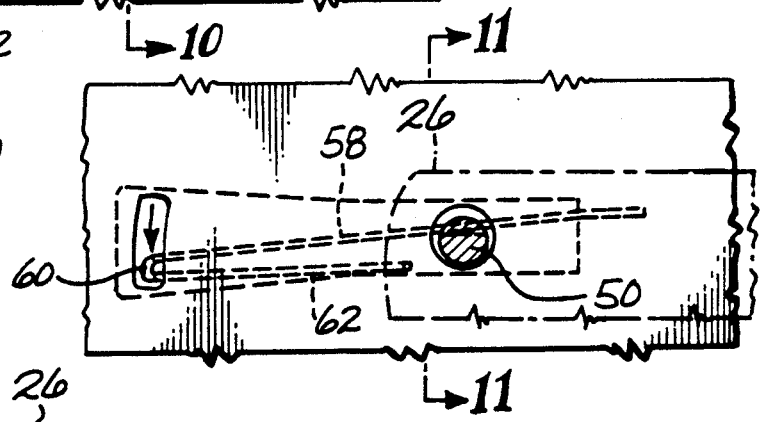
FIG. 9 shows the same view as in FIG. 8, but with the parts secured in place.
Figure 10:
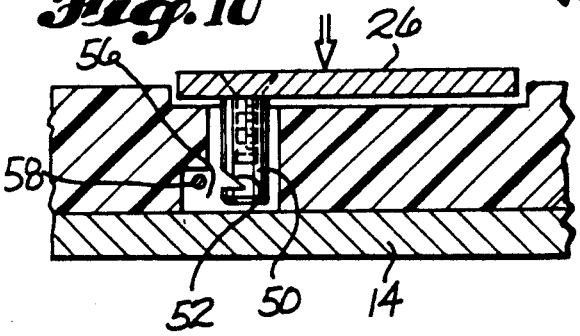
FIG. 10 is a cross sectional view taken along line 10—10 of FIG. 8.
Figure 11:
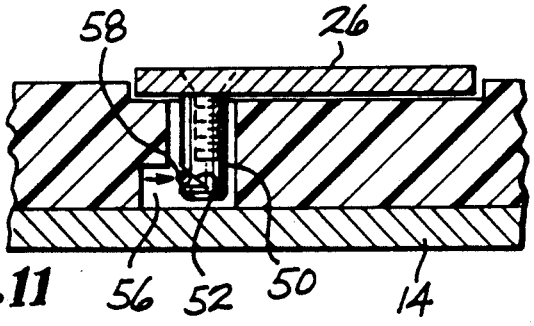
FIG. 11 is a cross sectional view taken along line 11—11 of FIG. 9.
Figure 12:
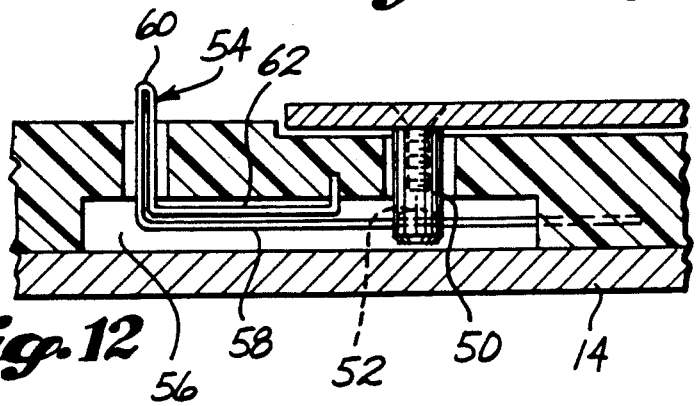
FIG. 12 is a longitudinal sectional view taken along line 12—12 of FIG. 8.
Figure 13:
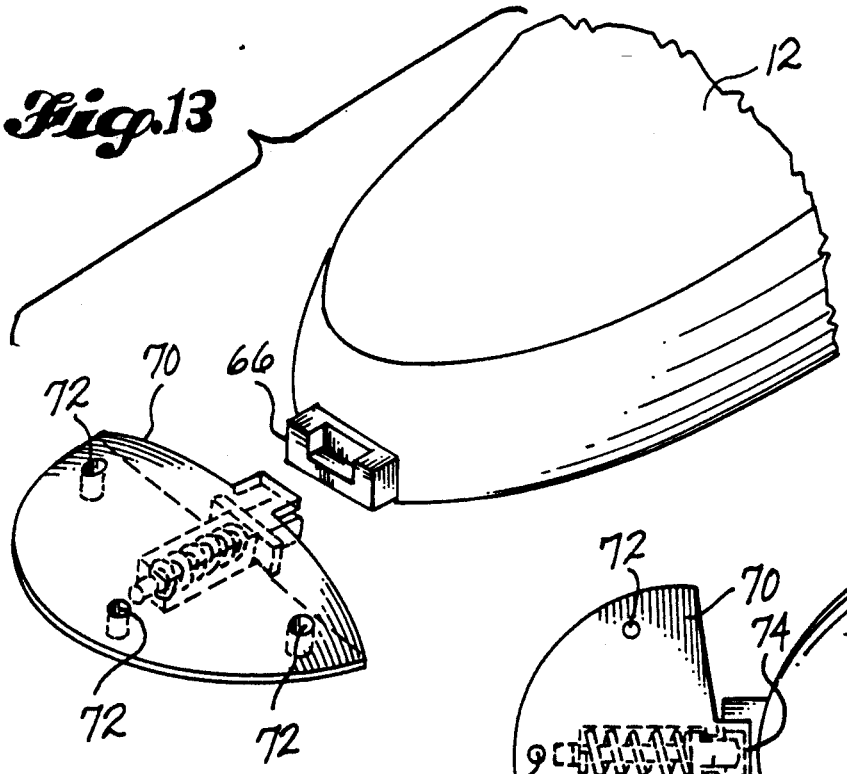
FIG. 13 is a top perspective view showing the front part of the front boot hold-down.
Figure 14:
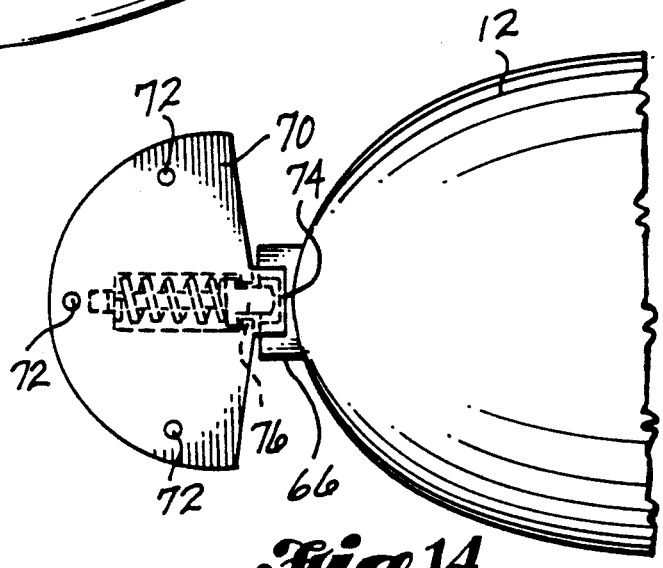
FIG. 14 is a plan view of FIG. 13.
Figure 15:
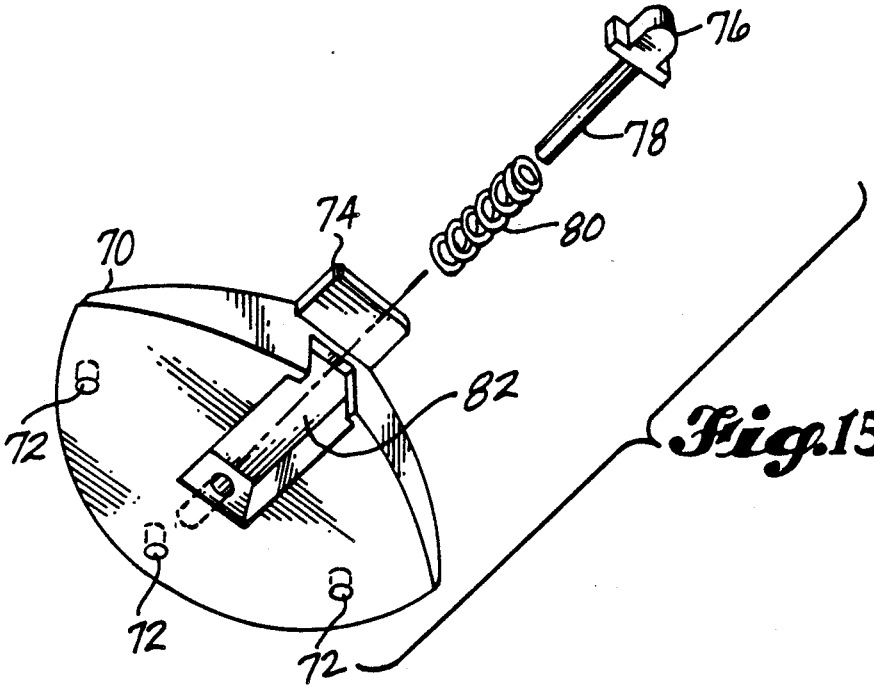
FIG. 15 is an exploded view of the hold-down for the front boot.
Figure 16:
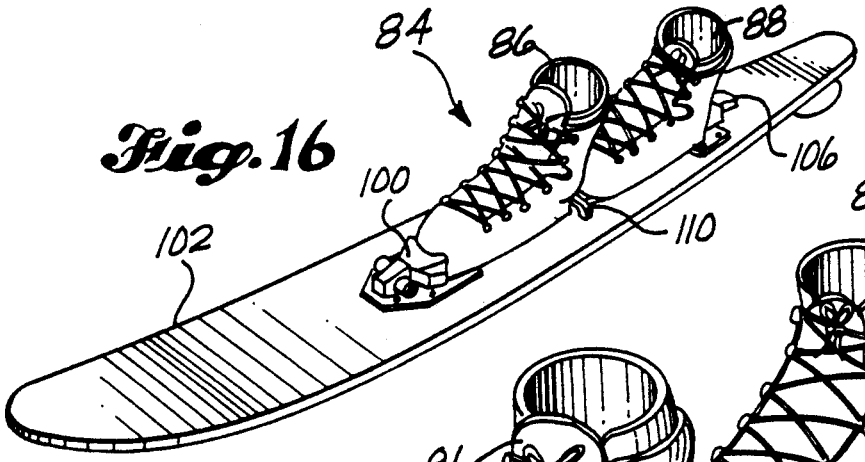
FIG. 16 is a top perspective view of a different embodiment of the invention.
Figure 17:
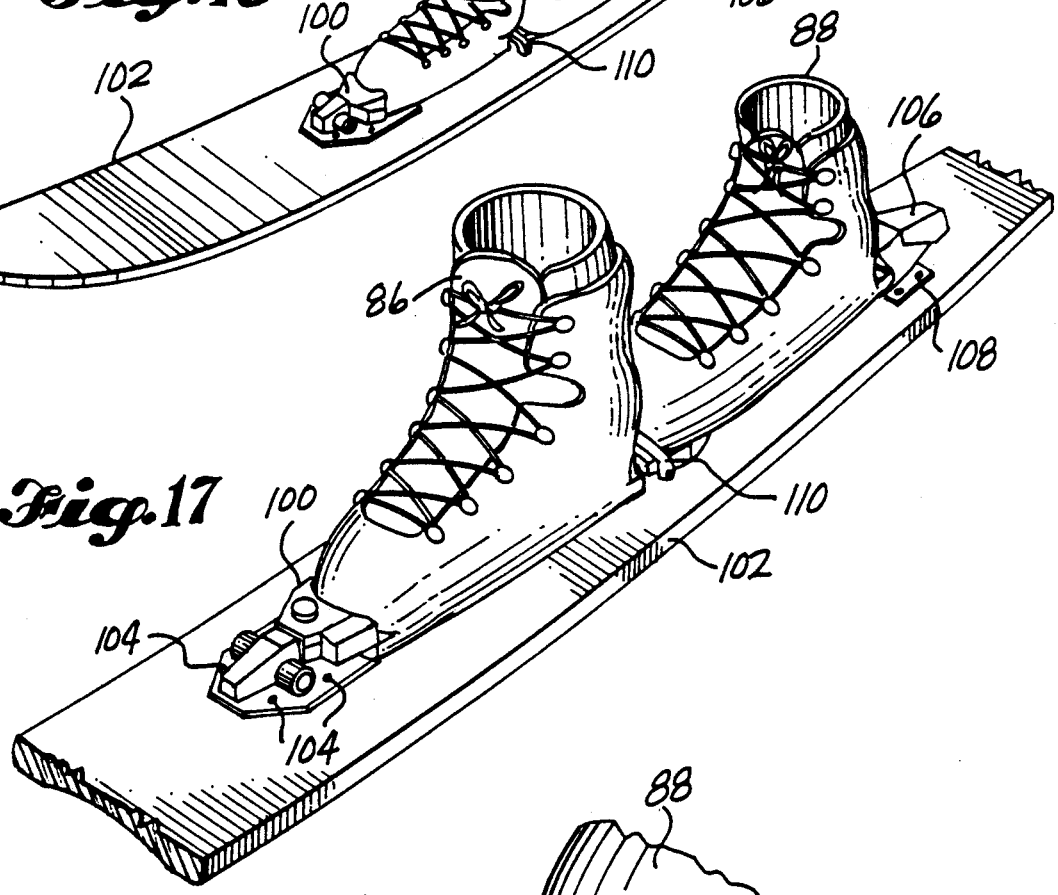
FIG. 17 is an enlarged top perspective view of a portion of FIG. 16.
Figure 18:
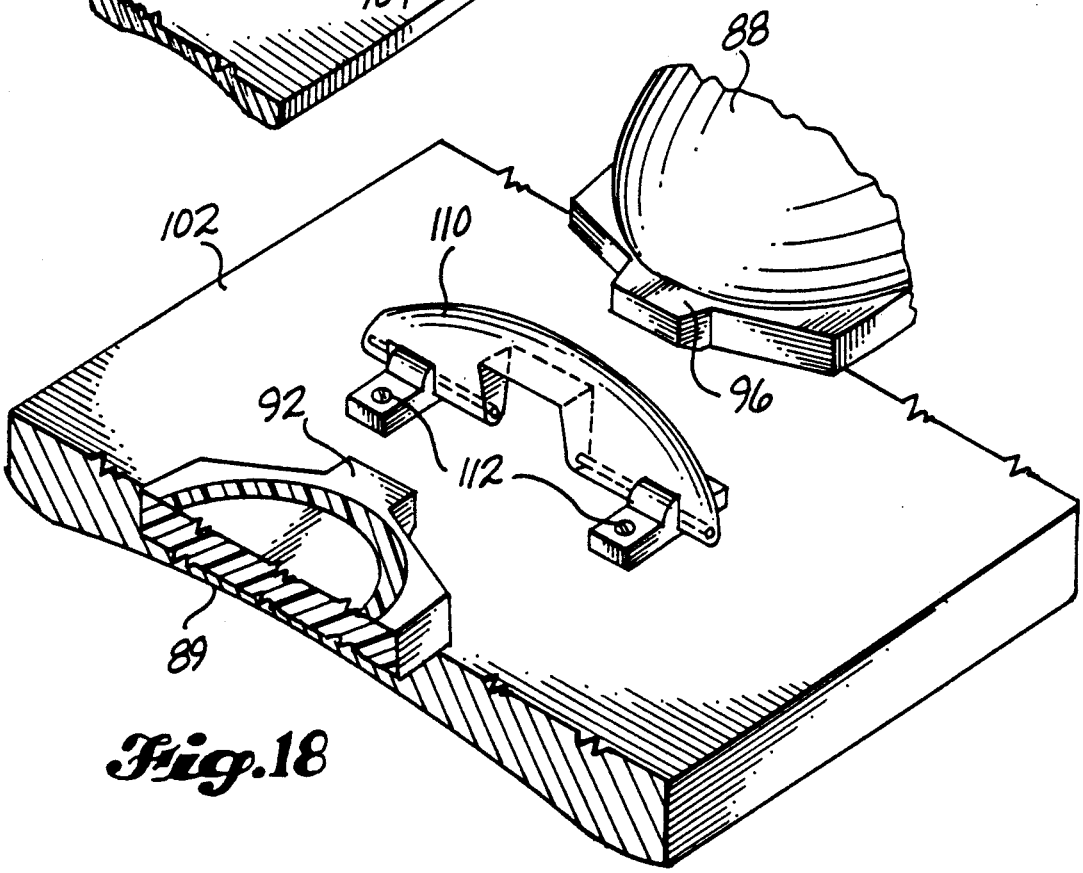
FIG. 18 is an exploded and further enlarged top perspective view showing details of the connection between boots.
Figure 19:
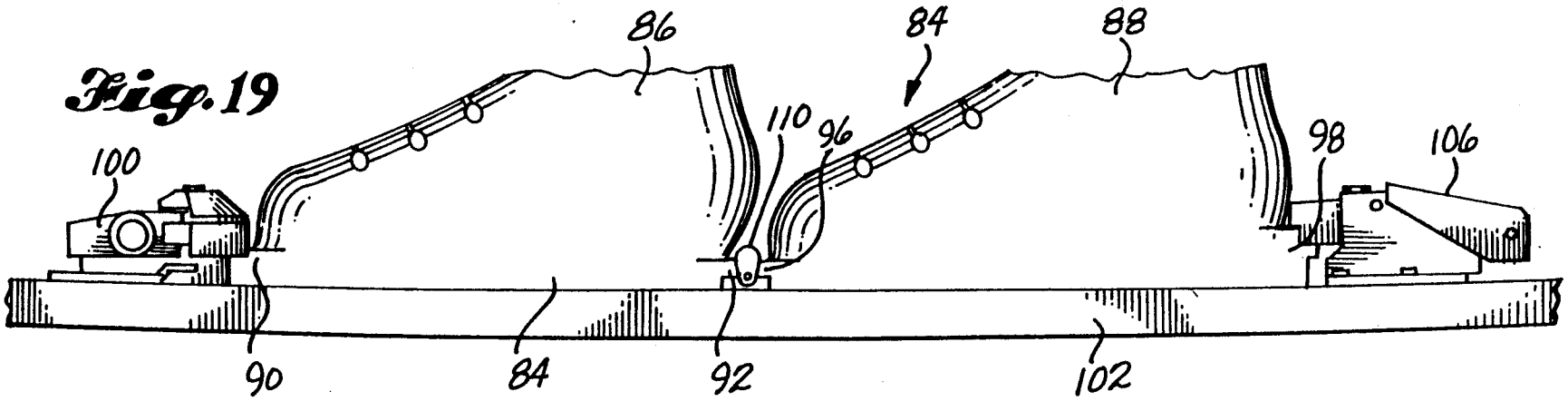
FIG. 19 is an enlarged side elevational view of FIG. 17 with parts broken away.
Figure 21:
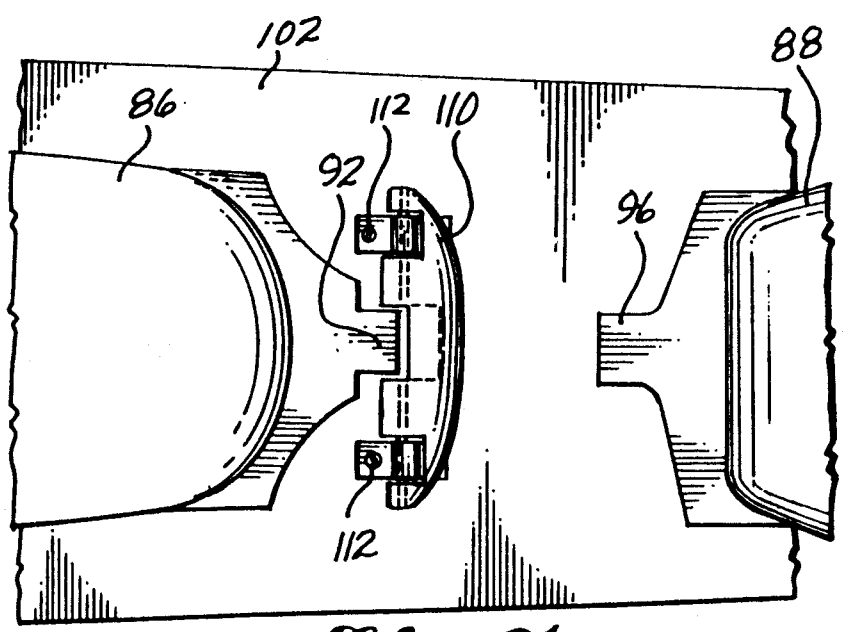
FIGS. 20 and 21 are detailed enlarged plan views of the connection between forward and rearward boots, FIG. 20 showing the boots joined, and FIG. 21 showing the rear boot released and the front boot being released.

A return bent resilient keeper wire 54 is received in a recess 56 of the base 18 and has a longer leg 58 extending alongside the notch 52 in boss 50. The return bent portion of wire 54 is bent upward to form a projection 60 at a right angle to the coplanar legs 58 and 62 which projection extends upward above the base 18. The leg 62 of the wire presses against the side of the recess 56 adjacent to the side of boss 50 opposite notch 52 so as to act as a spring for moving the wire leg 58 away from the notch 52 in the boss 50. When the lever 26 is pressed down manually nearly to the base 18 the upwardly extending projection 60 of the wire may be moved toward the boss 50 to insert the wire leg 58 in the notch 52 of the boss. If the lever is then released the wire leg 52 will be held in the notch 52 as shown in FIG. 9 owing to the torsion spring 34 acting on the lever arm 30 and lever 26 to urge such lever upward. When a foot 24 is inserted beneath the strap 22 the lever 26 and boss 50 will be moved down to wedge the wire leg 58 out of boss notch 52 to allow release of the boss 50 when the foot is withdrawn from the strap.

The forward boot 12 may be secured to a base plate having formed ends at the front and rear to cooperate with retainers mounted on the ski. However, in a preferred embodiment the boot 12 has a recessed forward end 66 and a rearward end projection 68. A holding member 70 secured to the ski with fasteners 72 has a projection 74 shaped to fit into the recess of the forward boot toe end to hold that end of the boot in place. Such projection overlies a boot plunger having a head 76 mounted on a rod 78 which extends through a compression spring 80. The plunger and spring are housed in a recess 82 in the holding member 70 and the rod head 76 is located to press against the boot forward end 66 beneath the recess into which projection 74 fits for pressing the boot rearward to maintain the heel latch engaged as the ski flexes beneath the boot during use.

Figure 7:
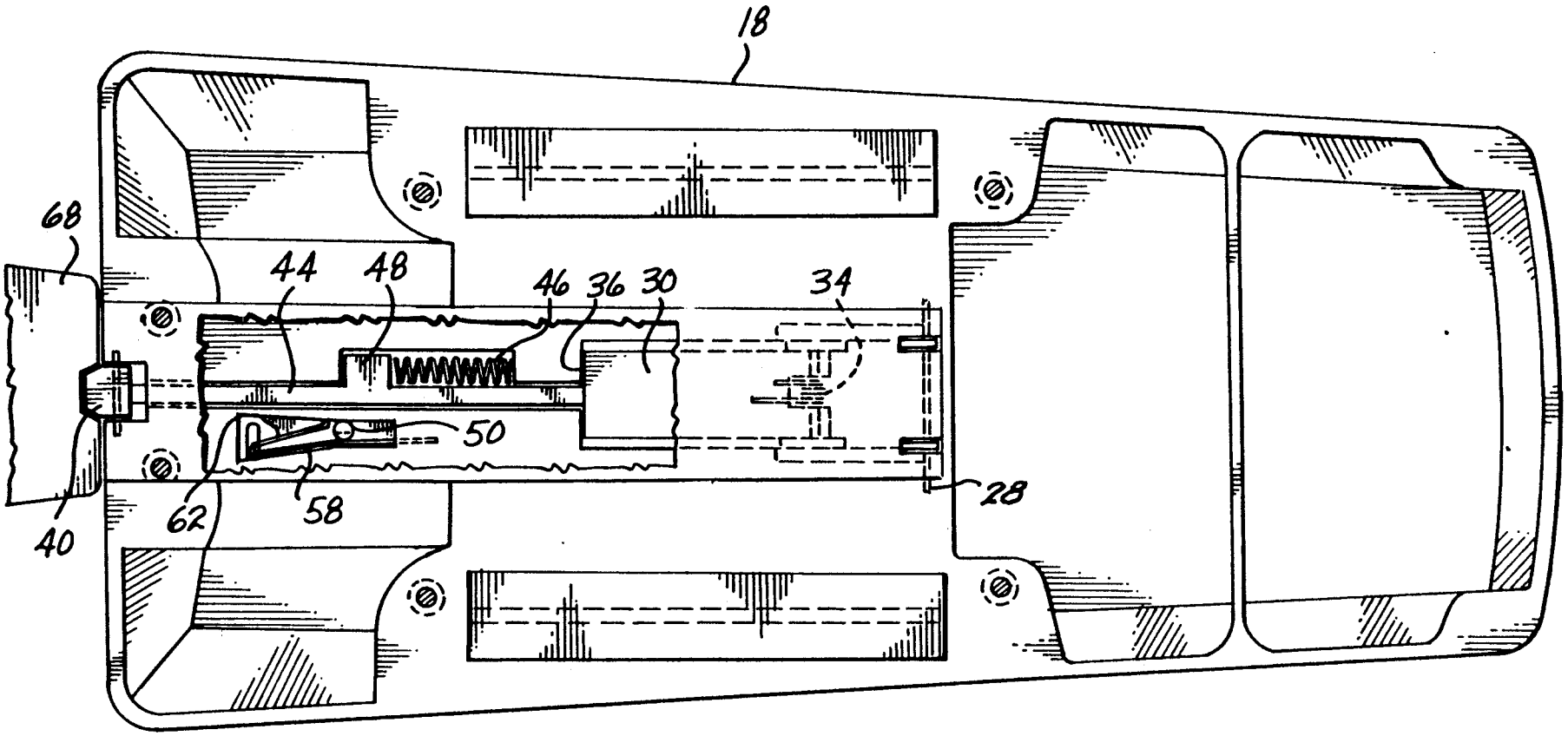
FIG. 7 shows a bottom view of FIG. 4.
Figure 8:
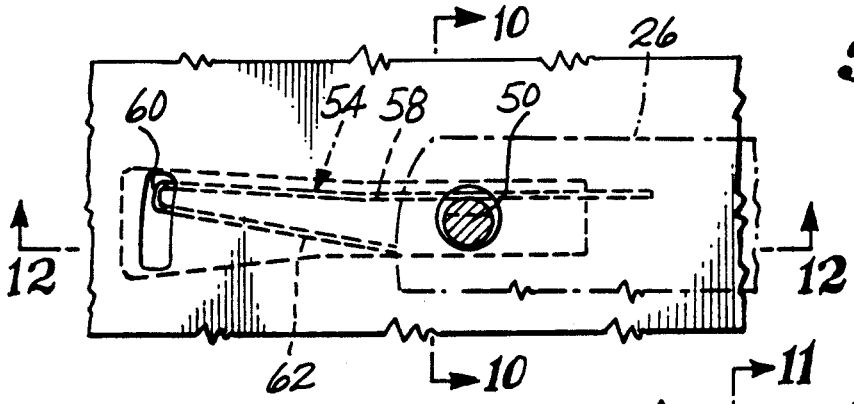
FIG. 8 shows a detailed plan view of hold-down parts in position ready to be secured in place.

As shown in FIG. 7, the sides of latch hook 40 are beveled and a notch in boot heel projection 68 is complementally flared to hold the boot heel in place when the latch is held in its forwardly swung position. Wedging engagement of the beveled surfaces enable a sidewise thrust of the boot heel to release the latch if such thrust is great enough.

In order to prepare the ski for skiing, the boot 12 is secured to the ski by the holding member 70 projection 72 being inserted into the recess in the boot toe end 66. Next the lever 26 is manually pressed down against the base and projection 60 of the return bent wire 54 is pressed sidewise, which moves leg 58 of the wire into notch 52 of the boss 50 where it remains when the lever is released as resilient upward pressure on the lever by the torsion spring 34 holds wire leg 58 in the notch 52. Such engagement of the wire in the boss notch holds the lever 26 down with the lever arm 30 holding rod 44 against latch 40 to maintain it in forwardly swung position locking the boot rearward projection 68 to the ski. The most convenient method of using the ski is to secure the front foot in the boot 12, start skiing, and then to insert the rear foot under the strap 22. When the rear foot presses against the lever 26 that lever is moved slightly downward which wedges wire leg 58 sidewise out of the notch 52 so that the lever 26 is set to release whenever the foot is removed from beneath the strap.

Should the rear foot be separated from the ski such as from a fall of the skier, the spring 34 presses lever arm 30 and the lever 26 apart, lifting lever 26, which draws the lever arm 30 rearward away from the boot 12, enabling the keeper 40 to be swung away from the boot for releasing boot projection 68. Such release enables the boot heel to be lifted so that the toe fitting 66 can move away from the projection 74, thus completely freeing the boot from the ski.

In another embodiment of the invention, shown in FIGS. 16 to 25, a ski binding 84 includes a front boot 86 and a rear boot 88. The front boot has a forwardly extending toe projection 90 and a rearwardly extending heel projection 92. The rear boot has a forwardly extending toe projection 96 and a rearwardly extending heel projection 98. A releasable hold-down keeper unit 100 engageable with the forward boot toe projection 90 is secured to the ski 102 by fasteners 104. This unit is shaped and located to receive the toe projection 90 for holding the toe of the forward boot in place. Behind the rear boot heel is another releasable hold-down keeper unit 106 secured to the ski by fasteners 108 in a position to receive heel projection 98 to hold the heel of the rearward boot in place.

Figure 20:
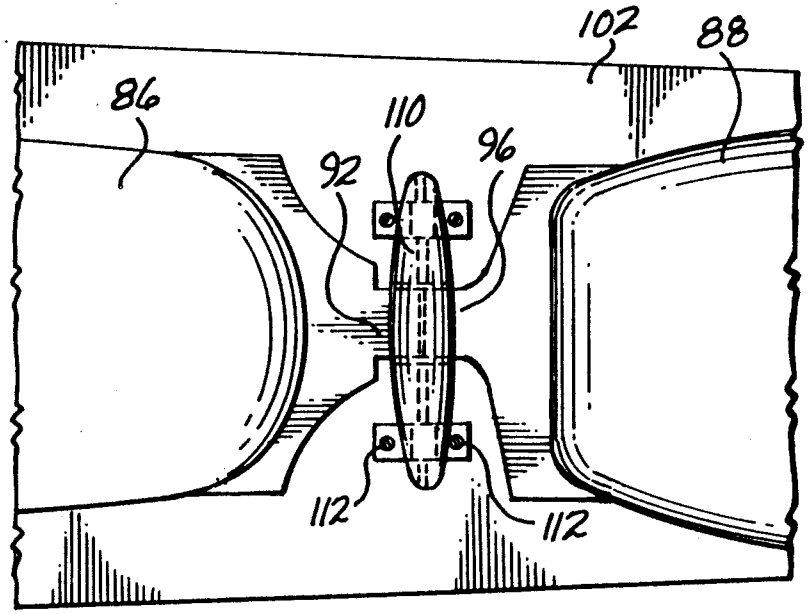
Figure 22:
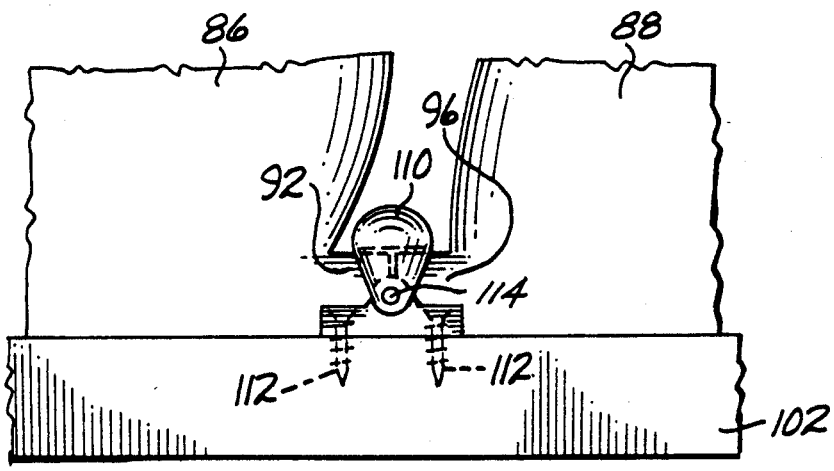
FIG. 22 shows a side elevational view of FIG. 20.

Between the heel of the forward boot 86 and the toe of the rearward boot 88 is a coupling loop or bail keeper 110, pivotally mounted by pin 114 and secured to the ski with rivets screw bolts fasteners 112 so as to be held against translation lengthwise of the ski. This coupling loop or bail can embrace both the heel projection 92 of the forward boot and the toe projection 96 of the rearward boot simultaneously as best shown in FIGS. 20 and 22, which projections constitute blocking means restraining swinging of the keeper bail 110 about its pivot 114.

Figure 23:
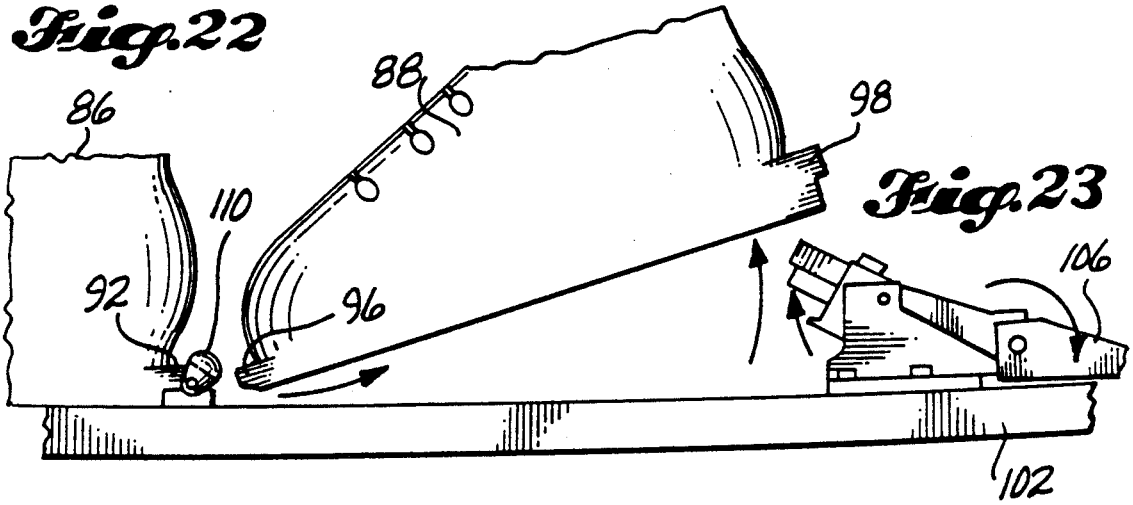
FIG. 23 shows a side elevational view similar to FIG. 22 with the rear boot releasing to free the front boot.
Figure 24:
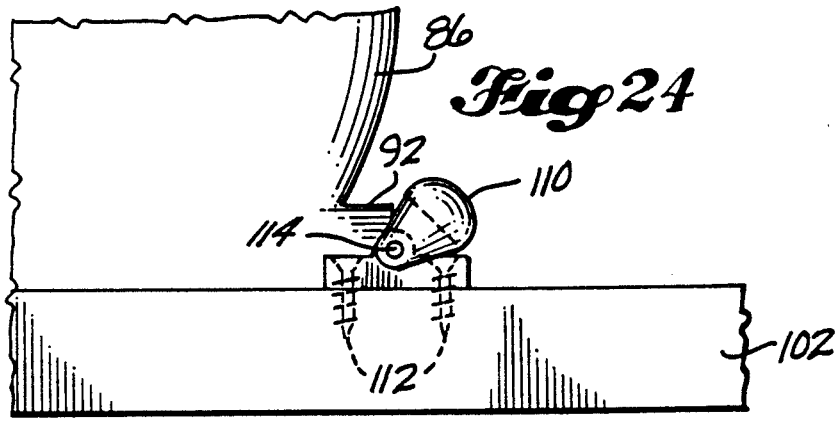
FIG. 24 is an enlarged view of FIG. 23.
Figure 25:
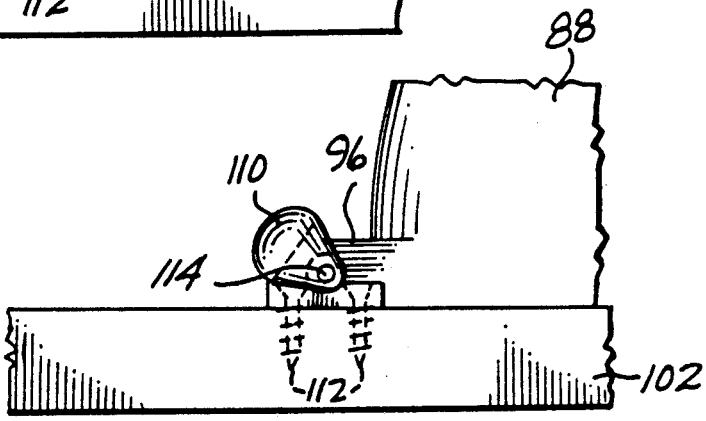
FIG. 25 shows a side elevational view similar to FIG. 24, but with the front boot released and the rear boot preparing to be released.

Should the rear boot 88 be released by excessive force being exerted on the releasable keeper unit 106 holding the heel of the rearward boot 88, as shown in FIG. 23, the rear boot will move away from the ski withdrawing the blocking means projection 96 from beneath the loop or bail 110, uncoupling the boots and enabling the keeper bail to swing rearward about its pivot 114, as best shown in FIG. 24 about its pivot 114. Such rearward swinging will disengage the bail from the heel projection 92 of the forward boot, enabling the heel of the forward boot to be lifted and the toe projection pulled from the hold-down 100 to release the forward boot from the ski.

To prepare the ski for use, the forward boot 86 is placed with its toe projection 90 inserted into forward hold-down keeper 100 and the bail keeper 110 is swung forward to cover heel projection 92. Next, toe projection 96 of the rearward boot 88 is inserted under the bail keeper 110 to block rearward swinging of the bail keeper. Then the hold-down latch 106 is swung to engage and hold the heel projection 98 of the rear boot 88 so that both boots will be held in position. When in skiing the skier exerts excessive force on either boot a hold-down of that boot will release. Whether the hold-down for the forward boot toe or the hold-down for the rear boot heel is thus released, the corresponding boot will pull away from the ski to withdraw one of the blocking projections 92 and 96 from under the coupling loop or bail keeper 110. Such loop will immediately swing away from the projection remaining under it to release that projection also so as to release the other boot from the ski.

We claim:

1. A releasable ski binding for holding a skier's front foot and rear foot in tandem arrangement on a single ski, comprising a forward boot, rear foot-engaging means rearward of said forward boot, holding means releasably attaching the toe of said forward boot to the ski, a keeper, pivot means held against translation lengthwise of the ski pivotally mounting said keeper adjacent to the heel of said forward boot, said keeper when in position swung forwardly about said pivot means releasably holding the heel of said forward boot to the ski, and means controlled by said rear foot-engaging means for releasing said keeper for rearward swinging away from its forwardly swung position to release said forward boot heel from the ski automatically in response to separation of the rear foot from the ski.

2. The ski binding defined in claim 1, in which the rear foot-engaging means includes a rearward boot, holding means releasably attaching the heel of said rear boot to the ski, and the keeper is a bail for holding the adjacent ends of the forward and rear boots when both boots are on the ski and movable to release one of the boots automatically when the other boot is separated from the ski.

3. A releasable ski binding for holding a skier's two feet in tandem arrangement on a single ski, comprising a boot for retaining one of the two feet, means for holding one end of said boot to the ski, a keeper, pivot means held against translation lengthwise of the ski and pivotally mounting said keeper on the ski adjacent to the other end of said boot for swinging into engagement with such other end of said boot for holding it to the ski and away from such other end of said boot for releasing it from the ski, footholding means for retaining the other of the two feet on the ski, blocking means restraining swinging of said keeper about said pivot means, and means operable automatically in response to removal of the other of the two feet from said foot-holding means for moving said blocking means to release said keeper for swinging thereof away from such other end of said boot to free said boot from the ski.

4. The ski binding defined in claim 3, in which the keeper is a bail, and the footholding means for retaining the other of the two feet includes a second boot held to the ski adjacent to the first boot and having a projection constituting the blocking means which extends under said bail that can be withdrawn by removing said second boot from the ski to enable said bail to swing away from the first boot.

5. The ski binding defined in claim 4, and releasable means holding to the ski the end of the second boot remote from the bail and releasable to release such end of the second boot from the ski by the application of force to said releasable means.

6. A releasable ski binding for holding a skier's two feet in tandem arrangement on a single ski, comprising a boot for retaining one of the two feet, means for holding one end of said boot to the ski, a keeper, pivot means held against translation lengthwise of the ski and pivotally mounting said keeper on the ski adjacent to the other end of said boot for swinging into engagement with such other end of said boot for holding it to the ski and away from such other end of said boot for releasing it from the ski, and foot-holding means for holding the other of the two feet to the ski and for holding said keeper in securing engagement with said boot when such other of the two feet is held by said foot-holding means and said foot-holding means releasing said keeper for swinging away from boot-holding position automatically in response to separation of the other of the two foot from the ski.

7. The ski binding defined in claim 6, in which the boot has a projection from an end, the keeper is a bail swingable over said boot projection, and the foot-holding means includes a second boot held to the same ski adjacent to the first boot and having a projection for extending under said bail and holding it in engagement with the projection of the first boot.

8. A single ski having a pair of boots formed by a forward boot and a rearward boot disposed in tandem adjacent relationship, comprising first detachable means for holding the toe end of the forward boot to the ski, second detachable means for holding the heel end of the rearward boot to the ski, at least one of said detachable means being releasable by the exertion of excessive force thereon, and releasable coupling means between the boots including a keeper and pivot means held against translation lengthwise of the ski and pivotally mounting said keeper, said keeper in one position holding the adjacent ends of the boots to the ski when the other ends of the boots are held to the ski by said detachable means and said keeper being swingable to release one of the boots when said detachable means of the other of the boots is disengaged to release such other of the boots.

9. The ski defined in claim 8, in which the keeper is a bail mounted by the pivot means to swing forward and backward about an axis extending transversely of the ski, the forward boot having a rearwardly extending heel projection insertable under said bail, and the rearward boot having a forwardly extending toe projection insertable under said bail to limit swinging of said bail.

10. The ski defined in claim 9, in which at least one of the detachable means includes means releasable by the application of excessive force thereto.

11. A single ski having a pair of boots formed by a forward boot and a rearward boot disposed in tandem adjacent relationship, comprising coupling means between the boots including a heel projection extending rearwardly from the heel of the forward boot, a toe projection extending forwardly from the toe of the rearward boot and loop means carried by the ski and engageable by said projections for holding adjacent ends of the boots to the ski, one of said projections being disengageable from said loop for enabling the other of said projections to be disengaged from said loop.

12. A releasable ski binding for holding a skier's two feet in tandem arrangement on a single ski, comprising a boot for retaining one of the two feet, means for holding one end of said boot to the ski, a keeper, pivot means held against translation lengthwise of the ski and pivotally mounting said keeper on the ski adjacent to the other end of said boot for swinging into engagement with such other end of said boot for holding it to the ski and away from such other end of said boot for releasing it from the ski, and means operable automatically in response to removal of the other of the two feet from the ski for enabling swinging of said keeper away from such other end of said boot to free said boot from the ski.

* * * * *

UNITED STATES PATENT AND TRADEMARK OFFICE

CERTIFICATE OF CORRECTION

PATENT NO. : 5,058,910

DATED : October 22, 1991

INVENTOR(S) : Roger C. Teeter and Larry C. Smith

It is certified that error appears in the above-identified patent and that said Letters Patent is hereby corrected as shown below:

Claim 6: column 6, line 3, cancel "foot" and insert --feet--.

Signed and Sealed this

Seventeenth Day of May, 1994

Bruce Lehman

*Attest:*

BRUCE LEHMAN

*Attesting Officer*

*Commissioner of Patents and Trademarks*